US007574960B1

(12) United States Patent
Dockery et al.

(10) Patent No.: US 7,574,960 B1
(45) Date of Patent: Aug. 18, 2009

(54) IGNITION ELEMENT

(75) Inventors: Luther Damian Dockery, Waldorf, MD (US); Peter Margiotta, La Plata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 177 days.

(21) Appl. No.: 11/296,710

(22) Filed: Nov. 29, 2005

(51) Int. Cl.
*F42B 3/12* (2006.01)

(52) U.S. Cl. ..... 102/202.8; 102/202.7; 102/202.9; 102/202.14; 102/472

(58) Field of Classification Search ..... 102/202.7, 102/202.8, 202.9, 202.11, 202.14, 472
See application file for complete search history.

(56) References Cited

U.S. PATENT DOCUMENTS 606,440 A * 6/1898 Bennett ..... 102/202.9
2,696,191 A * 12/1954 Sheehan ..... 102/202.9
4,600,123 A * 7/1986 Galbraith ..... 222/3
4,771,692 A * 9/1988 Ninio et al. ..... 102/202.2
4,881,463 A 11/1989 Ninio et al.
5,029,529 A * 7/1991 Mandigo et al. ..... 102/202.9
5,155,295 A 10/1992 Campoli
5,221,109 A * 6/1993 Marchant ..... 280/736
5,277,121 A 1/1994 Campoli et al.
5,465,665 A 11/1995 Diehl
5,509,480 A * 4/1996 Terrell et al. ..... 166/297
5,705,766 A 1/1998 Farace et al.
6,131,515 A * 10/2000 Cook et al. ..... 102/202.8
6,186,071 B1 * 2/2001 Fry ..... 102/515
6,314,887 B1 * 11/2001 Robinson ..... 102/262
6,543,362 B1 4/2003 Muskat
6,543,363 B2 4/2003 Brion
6,708,621 B1 3/2004 Forichon-Chaumet et al.
6,857,370 B1 2/2005 May

* cited by examiner

*Primary Examiner*—Stephen M Johnson
(74) *Attorney, Agent, or Firm*—Frederic J. Zimmerman

(57) ABSTRACT

An ignition element is provided for integration into a primer assembly. The ignition element includes an electrode housing including at least one cavity and an electrode disposed in the electrode housing. The electrode housing and electrode are electrically isolated from each other using insulators. A bridgewire and a primary ignition charge are located in the cavity such that upon application of current to the electrode the pyrotechnic ignition charge is ignited. A headstock is provided, and the electrode housing is threadably disposed within the headstock. Burst disks cover the cavity and separate the ignition charge from a primer charge containing powder disposed in a single booster holder.

22 Claims, 3 Drawing Sheets

IGNITION ELEMENT

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

FIELD OF THE INVENTION

The present invention relates to the field of pyrotechnics and propellants. In particular, the present invention relates to ignition elements used in primer assemblies.

BACKGROUND OF THE INVENTION

In general, an explosive is a material that reacts chemically to generate gases at high temperatures and pressures. The expansion of these gases is used to produce a wide range of effects including destructive blast effects, propellant effects and gas generation. These explosive materials are ignited by smaller charges, i.e. primer charges, contained within primers, which are in turn ignited by an initiator containing a small initiator charge.

Initiators are typically used to prime a priming composition located within a primer. The priming composition is used to ignite the main charge in an ordinance, shell, rocket, actuator or gas generator. In ammunition, the main charge acts as a propellant charge to propel a projectile or shell. In a gas generator, the main charge is used to generate gas, for example, for use in an airbag or seatbelt tightener. The main charge is typically an energetic material such as an energetic pyrotechnic chemical or black powder. The initiator includes an initiator charge that is ignited by either electricity or percussion, and the initiator charge ignites the primer charge, which ignites the main charge. The initiator, the primer and the main charge are disposed in various housings that are typically connected together so as to be placed in the necessary contacting arrangement for proper functioning of the pyrotechnic device.

Percussion initiators use a physical force to ignite either the initiator charge or the primer charge. An electrical initiator typically contains two contact pins. Between the two contact pins a resistor element is disposed, for example a metal film element or an incandescing wire. An initiator charge adjoins the resistor element. Upon application of current to the contact pins, the initiator charge ignites as a result of the high temperature of the resistor element. The ignited initiator charge ignites the primer charge. Therefore, the electrical initiator is the start of the ignition sequence in an electric primer.

Initiators, primers, and main charges are all exposed to both high temperatures and pressures resulting from the ignition of the energetic material contained therein. These high temperatures and pressures can result in flaws within the various components including the primer, initiator and main charge, and of the seals between these various elements, including conventional pressure fit seals. These flaws include potential escape paths for the hot gases generated by the energetic materials in addition to locations for burn throughs. Therefore, an arrangement of initiators and primers is desired that eliminates potential flaws resulting from the ignition of the initiator charges, primer charges, or main charges. Accordingly, Applicant has developed a novel seal arrangement using threads among the components to minimize the damage due to escaping hot gases and burn throughs.

SUMMARY OF THE INVENTION

The present invention is directed to an ignition element for integration into a primer assembly. The ignition element includes an electrode housing containing at least one cavity and an electrode disposed in the electrode housing. The electrode includes a first end disposed in the cavity and a second end opposite the first end and exposed for application of a current to the second end. The electrode housing and electrode are electrically isolated form each other, for example by use of at least one insulator disposed between the electrode and the electrode housing. These insulators are generally constructed from polyetheretherketone.

A resistance element, for example a bridgewire, is located in the cavity between the first end of the electrode and a source of electric ground. Also disposed in the cavity is a pyrotechnic ignition charge, for example, a mixture of lead styphnate and nitrocellulose. The resistance element, upon application of a sufficient amount of current to the second end of the electrode, generates a sufficient amount of heat to ignite the pyrotechnic ignition charge.

A headstock is provided, and the electrode housing is disposed within the headstock such that the second end of the electrode passes through the headstock. An insulator is provided between the headstock and the electrode and, in particular, the insulator may be constructed from polyetheretherketone. The headstock is constructed from a chrome-moly alloy steel. The electrode housing is threaded into the headstock. These same tolerances are applied to the fit among the insulators, electrode and electrode housing. Adhesives and epoxies can also be used to enhance or strengthen the fit among these components.

Two burst disks cover the cavity and separate the ignition charge from a primer charge. In use, the pyrotechnic ignition charge ruptures the burst disks, igniting the primer charge. The burst disk can be constructed from the same material or from different materials and can be used in conjunction with other parts of the ignition element, for example as a source of ground for the resistance element. The primer charge includes about 850 grams of black powder disposed in a single booster holder.

DETAILED DESCRIPTION

Figure 1:
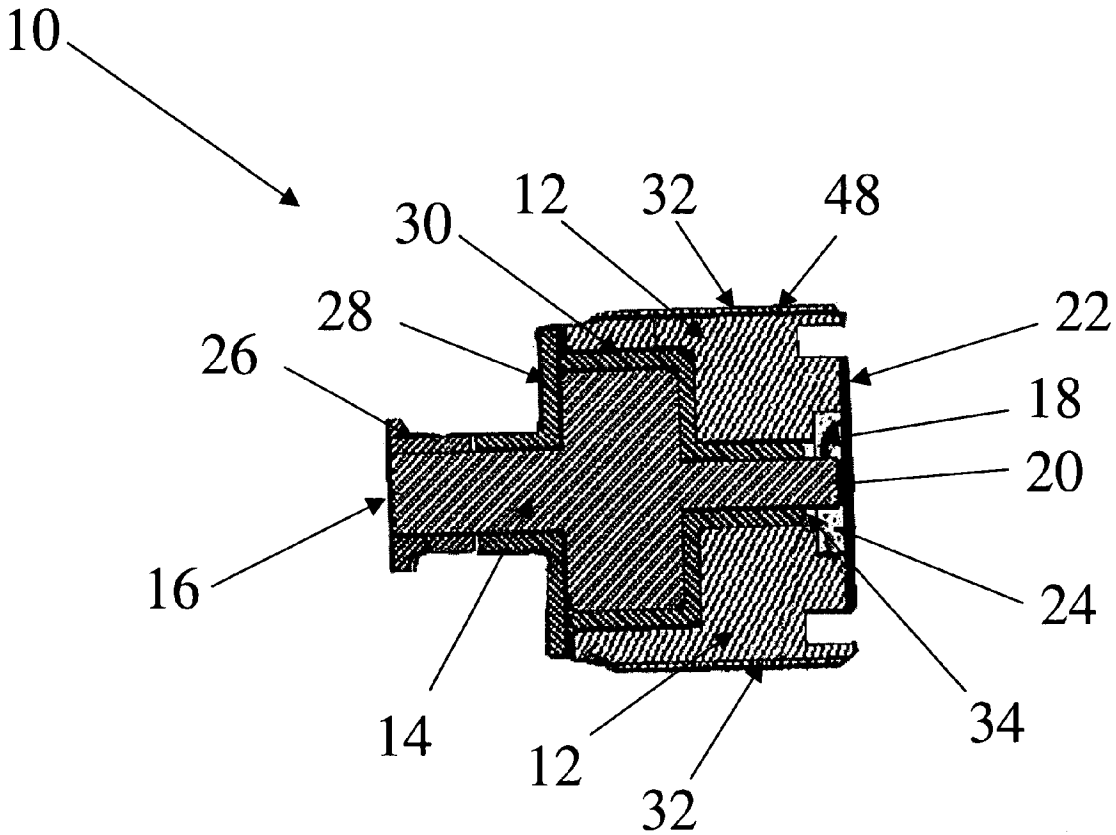
FIG. 1 is cross-section of an embodiment of an ignition element in accordance with the present invention.

Referring to FIG. 1, an exemplary embodiment of an ignition element 10 in accordance with the present invention is illustrated. The ignition element includes an electrode housing 12. Suitable materials for the electrode housing are known and available in the art. In one embodiment, the electrode housing 12 includes a first part, that is, first threads, 32 of a two-part threaded fitting so that the electrode housing 12 can be threaded into a housing or headstock 38. The first threads 32 are located on a surface of the electrode housing 12. The second part, that is, second threads, 48 of the two-part threaded fitting are the corresponding threads situated on a surface of the housing or headstock 38. The first part 32 threadably mates, or engages, with the second part 48 so that the first part 32, or first threads, contact the second part, or second threads 48. Accordingly, in an embodiment, the electrode housing 12 is threaded into a cavity of the headstock 38 so as to be threadably anchored, or engaged, to the headstock 38. Threading of the electrode housing provides a more torturous path for gases that try to escape through the ignition element during actuation of the ignition element. In addition, the threaded fitting can be used to establish a pre-load on the components of the ignition element, for example insulators and sealants, providing added sealing efficiency. The first part 32 and second part 48 are each composed of threads with standard dimensions and, in an embodiment; the dimensions include a 0.750 dia-32 UN-2A.

Disposed within the housing 12 is at least one electrode 14. The electrode 14 is constructed from an electrically conductive material. Suitable electrically conductive materials are known and available in the art. In one embodiment, the electrode 14 and electrode housing 12 are arranged as generally concentric cylindrical assemblies with the electrode 14 running generally through the middle of the electrode housing, although other shapes and arrangements of electrodes and electrode housings are possible. In addition, as illustrated a single electrode is used; however, multiple electrodes can also be used, for example two electrodes, one positive and one negative.

The electrode housing 12 includes at least one cavity 24 arranged to hold a pyrotechnic ignition charge or initiating mixture. Suitable ignition charges include any pyrotechnic ignition charge material including black powder, lead styphnate, nitrocellulose or guncotton and mixtures thereof. In an embodiment, the initiating mixture is a mixture of lead styphnate and nitrocellulose. The electrode includes a first end 20 that is disposed within the cavity 24, and a second end 16 opposite the first end 20. The second end 16 is generally exposed in the assembled ignition element and in any primers or devices into which the ignition element 10 is integrated to facilitate contact of the second end 16 with a current source to actuate the ignition element 10.

In order to facilitate proper electrical operation of the ignition element and to inhibit uncontrolled actuation, the electrode 14 is electrically insulated from the electrode housing 12. In one embodiment, the ignition element 10 includes at least one insulator disposed between the electrode 14 and the electrode housing 12. Alternatively, a plurality of insulators is disposed between the electrode 14 and the electrode housing 12. In one exemplary embodiment as illustrated, the insulators include a top insulator 30 disposed between the electrode 14 and the electrode housing 12 and generally adjacent the first end 20 of the electrode 14 and a bottom insulator 28 disposed between the electrode 14 and the electrode housing 12 and generally adjacent the second end 16 of the electrode. In another embodiment, the insulators also include a primer stock insulator 26 disposed between the electrode 14 and the electrode housing 12 or any housing or support structure into which the electrode 14 and electrode housing 12 are disposed, for example a headstock. In one embodiment, the bottom insulator 28 is disposed along a length of the electrode 14 between the top insulator 30 and the primer stock insulator 26.

Suitable materials for the insulator are capable of withstanding the operating pressures and temperatures to which the ignition element 10 is exposed. In an embodiment, the insulator is constructed from polyetheretherketone. The insulators 26, 28, 30 can be pressure fit against the electrode 14 or can be attached to the electrode 14 using an adhesive or epoxy material. In one embodiment, the insulators are attached to the electrode using a two-part epoxy adhesive that provides the desired level of shear and peel adhesion and durability. Suitable two-part epoxy adhesives include Scotch-Weld™ Epoxy Adhesive DP-460, which is commercially available from the 3M Company of St. Paul, Minn. In one embodiment, the ignition element 10 also includes a sealant 34 between the top insulator 30 and the cavity 24. Suitable sealants include, but are not limited to, 3M™ Scotchcast™ which is commercially available from the 3M Company of St. Paul, Minn.

In one embodiment, the ignition element 10 also includes a resistance element 18 disposed between the first end 20 of the electrode 14 and a source of electrical ground. The resistance element 18 is capable of generating a sufficient amount of heat to ignite the pyrotechnic ignition charge in the cavity 24 upon application of a current to the second end 16 of the electrode 14. Suitable resistance elements produce a sufficient amount of thermal energy to initiate combustion in the initiating mixture and include filaments, metals films and bridgewires. In one embodiment, the electric resistance element includes a high-resistance wire, for example, a bridgewire, in operative contact with the pyrotechnic ignition charge. For example, the wire can be wrapped in a wisp of guncotton and contained in a mixture of pulverized guncotton and fine black powder in the cavity in the electrode housing. Alternatively, the wire is contained in a mixture of lead styphnate and nitrocellulose. The wire is connected at one end to the first and of the electrode. The opposite end of the wire is connected to ground. Connection to ground can be accomplished through connection to a second electrode, which is connected to ground or through connection to a conducting source, such as, a metallic housing that is connected to ground. In one embodiment, the opposite end of the wire is grounded through the primer stock 38 and the cartridge case to the metal of a gun.

In one embodiment, the ignition element also includes at least one burst disk 22 in contact with the electrode housing 12 and covering the cavity 24. In one embodiment, the burst disk 22 is also in contact with the first end 20 of the electrode 14 to function as the resistance element. Alternatively, the burst disk 22 is in contact with the resistance element 18 to provide a source to ground. In an embodiment, the ignition element 10 includes two overlapping burst disks, collectively, referred to as 22. In one embodiment, the two burst disks 22 are constructed from substantially the same material. In another embodiment, the two burst disks 22 are constructed from substantially different materials. Suitable burst disks are constructed from both electrically conductive and non-conductive materials including plastics, polymers, metals, for example, nickel, metallic foils, graphite and combinations thereof. In one embodiment, the first burst disk 22 is a conductive material, and the second burst disk 22 is an insulating material. Since the first disk 22 is placed in contact with the cavity containing the pyrotechnic initiating mixture, the first end 20 of the electrode 14 and the bridgewire, the first burst disk can be placed in contact with the bridgewire to provide a grounding connection, and the second burst disk insulates the first burst disk, which is part of the resistance element, from undesired or unanticipated electrical interference.

The ignition element 10 can be used in any application to initiate a primer charge, propellant charge, explosive actuator or gas generator, for example in an air bag deployment system. The ignition element in accordance with the present invention and assemblies into which it is integrated provide improved reliability and performance at operating pressures up to about 100,000 psi. Generally, operating pressures are in the range from about 60,000 psi to about 80,000 psi, and in particular, about 65,000 psi or more particularly about 75,000 psi.

Figure 2:
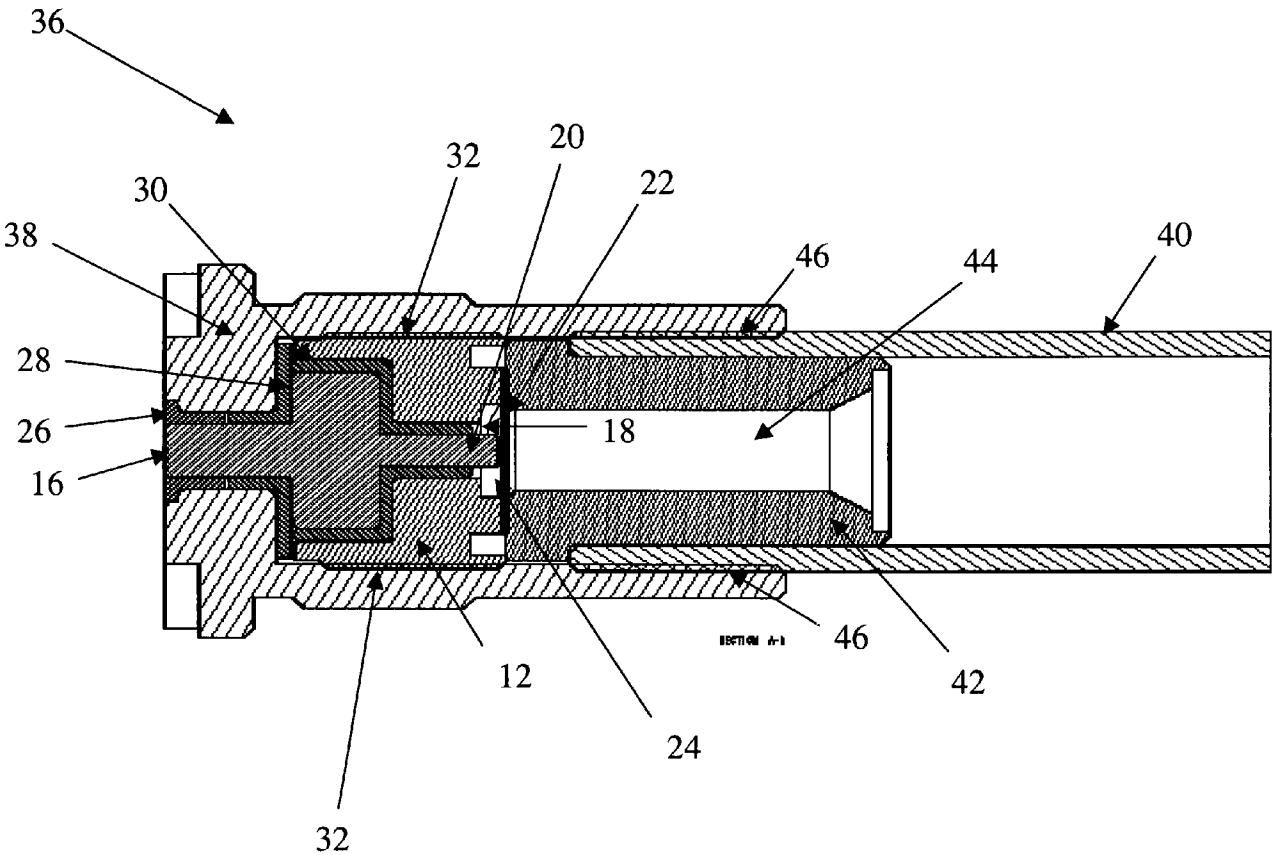
FIG. 2 is a first cross-section of an embodiment of a primer assembly containing the ignition element of FIG. 1.
Figure 3:
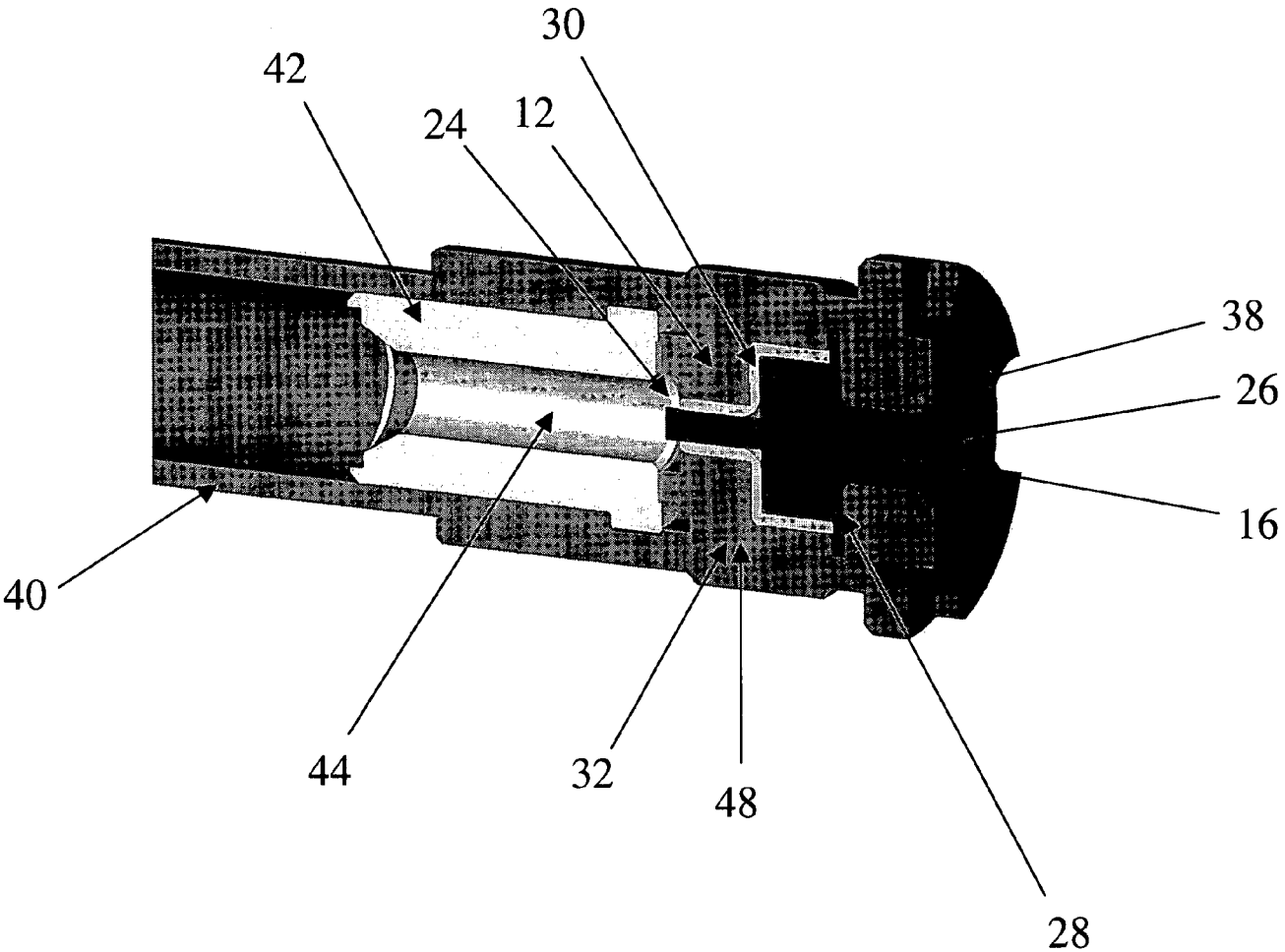
FIG. 3 is a second cross-section of an embodiment of a primer assembly containing the ignition element of FIG. 1.

Referring to FIGS. 2 and 3, in one exemplary embodiment, the ignition element 10 is integrated into a primer assembly 36. The electrode housing 12 and electrode are disposed within a housing or headstock 38. In general, a headstock refers to a part of an assembly containing or directly supporting the operative parts. Although illustrated as independent of the ignition element 10, in an alternative embodiment, the headstock 38 can be considered as part of the ignition element 10. Suitable materials for the headstock include plastics and metals. In an embodiment, the headstock 38 is made from a chrome-moly alloy steel, that is, a chromium molybdenum based steel. The electrode housing 12 and electrode 14 are disposed in the headstock 38 such that the second end 16 of the electrode 14 passes through the headstock 38. In one embodiment, the electrode housing 12 is threaded into the headstock 38, and the headstock 38 includes a complimentary second part to the first part 32 of the two-part threaded fitting. Alternatively, the electrode housing 12 is force or press fit into the headstock 38. The tolerances between the electrode housing 12 and the headstock 38 reduce potential gaps in the assembly. It is also desired to eliminate these gaps between the electrode housing, the electrode and the insulators. In one embodiment, the tolerances between any two of the electrode, electrode housing, headstock or insulators are less than about 0.005 inches. In an embodiment, these tolerances are less than about 0.001 inches.

A booster holder 42 including a primer charge 44 is brought into contact with the electrode housing 12 and the burst disks 22. A primer tube 40 is then either press fit or threaded using a two-part threaded fitting 46 into the headstock 38 forming a single primer assembly that can then be integrated into a larger assembly such as a rocket, shell or propelling charge. In one embodiment, the burst disks 22 separate the pyrotechnic ignition charge from the primer charge 44. When the pyrotechnic ignition charge is ignited, it ruptures the burst disks 22, igniting the primer charge 44. Overall, the arrangement of the ignition element 10 and the primer assembly 36 reduces the number of parts required by about half, reducing costs, assembly complexity and the number of joints or gaps that could be points of failure or weakness. In addition, the reduction of the number and complexity of the parts facilitates the use of a larger booster holder 42 and a single, larger primer charge disposed in a single area. In one embodiment, the primer charge 44 contains about 850 grams of black powder disposed in the single booster holder 42.

In use, the ignition element 10 and primer assemblies 36 into which it is integrated are used to initiate a flame for the ultimate purpose of igniting a charge of propellant or gas generation. The initiator or ignition element is used to initiate the flame in the primer assembly. Although ignition elements can be percussion, electric or combination initiators, in an embodiment, the ignition element of the present invention is electric. In electric initiation elements, firing is accomplished by passing a current through an electrode and a resistance element surrounded by a pyrotechnic initiating charge or initiating mixture. The resistance element produces a sufficient amount of thermal energy to initiate combustion in the initiating charge, which causes a burst disk to rupture, exposing the primer charge to the heat and pressure of the ignited charge and igniting the primer charge. The primer charge travels through the primer tube in which is disposed to initiate the main propellant or gas generating charge.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An ignition element, comprising:

an electrode housing comprising a thread portion and at least one cavity;

an electrode being disposed in the electrode housing, wherein the electrode comprises a first end disposed in each of said at least one cavity and a second end opposite the first end;

at least one insulator disposed between the electrode and the electrode housing, wherein each of said at least one insulator comprises polyetheretherketone;

a resistance element disposed between the first end of the electrode and a headstock;

a pyrotechnic ignition charge being disposed in said each of said at least one cavity;

at least one burst disk being in contact with the electrode housing and covering said at least one cavity for separating the pyrotechnic ignition charge from a primer charge, wherein the pyrotechnic ignition charge ruptures said at least one burst disk upon ignition and ignites the primer charge, wherein the resistance element is capable of generating a sufficient amount of heat to ignite the pyrotechnic ignition charge upon application of a current to the second end of the electrode, and wherein the primer charge comprises about 850 grams of black powder disposed in a single booster holder.

2. The ignition element of claim 1, wherein said at least one insulator comprises a top insulator disposed between the electrode and the electrode housing and generally adjacent the first end of the electrode, and a bottom insulator disposed between the electrode and the electrode housing and generally adjacent the second end of the electrode, and wherein said top insulator and said bottom insulator are comprised of polyetheretherketone.

3. The ignition element of claim 1, further comprising a primer stock insulator being disposed between the electrode and the headstock, wherein the electrode housing is disposed within the headstock such that the second end of the electrode passes through the headstock, and wherein the primer stock insulator is comprised of polyetheretherketone.

4. The ignition element of claim 3, wherein the bottom insulator is disposed along a length of the electrode between the top insulator and the primer stock insulator.

5. The ignition element of claim 1, wherein said at least one burst disk comprises two overlapping burst disks.

6. The ignition element of claim 5, wherein the two overlapping burst disks are comprised of substantially same material.

7. The ignition element of claim 5, wherein the two burst overlapping disks are comprised of substantially different materials.

8. An ignition element, comprising:

a headstock comprising a first thread portion;

an electrode housing being disposed in the headstock housing, wherein said electrode housing comprises a second thread portion and at least one cavity;

an electrode being disposed in the electrode housing, wherein the electrode is a cross-shaped electrode comprised of a first end disposed in said at least one cavity and a second end opposite the first end, and wherein the electrode is electrically insulated from the electrode housing and the headstock;

a resistance element being disposed between the first end of the electrode and the headstock; and a pyrotechnic ignition charge being disposed in the cavity, wherein the resistance element is capable of generating a sufficient amount of heat to ignite the pyrotechnic ignition charge upon application of a current to the second end of the electrode.

9. The ignition element of claim 8, wherein electrical insulation between the electrode and the electrode housing and the headstock is provided by a plurality of insulators, each of said plurality of insulators is comprised of polyetheretherketone.

10. The ignition element of claim 9, wherein tolerances between the electrode, electrode housing and said plurality of insulators are less than about 0.005 inches.

11. The ignition element of claim 9, wherein tolerances between the electrode, electrode housing and said plurality of insulators are less than about 0.001 inches.

12. The ignition element of claim 8, further comprising at least one burst disk being in contact with the electrode housing and covering said at least one cavity for separating the pyrotechnic ignition charge from a primer charge, wherein the pyrotechnic ignition charge ruptures said at least one burst disk upon ignition and ignites the primer charge.

13. The ignition element of claim 8, wherein the first portion and the second portion are a two part threaded fitting, and wherein the electrode housing is threaded into the headstock through the two part threaded fitting.

14. An ignition element, comprising:

an electrode housing comprising at least one cavity and a first part of a two part threaded fitting;

a headstock complimentary comprising a second part of the two part threaded fitting such that the electrode housing is threaded into the headstock;

an electrode being disposed in the electrode housing, wherein the electrode is a cross-shaped electrode comprised of a first end disposed in said at least one cavity and a second end opposite the first end, and wherein the electrode is electrically insulated from the electrode housing and the headstock;

a resistance element being disposed between the first end of the electrode and the headstock; and a pyrotechnic ignition charge being disposed in the cavity;

wherein the resistance element generates a sufficient amount of heat to ignite the pyrotechnic ignition charge upon application of a current to the second end of the electrode.

15. The ignition element of claim 14, further comprising two burst disks in contact with the electrode housing.

16. The ignition element of claim 15, wherein the two burst disks are comprised of a same material.

17. The ignition element of claim 15, wherein the two burst disks are comprised of different materials.

18. An ignition element, comprising:

a headstock;

an electrode housing being threadably anchored in the headstock;

an electrode being disposed in the electrode housing, wherein the electrode is a cross shaped electrode comprised of a first end disposed in a cavity of said electrode housing;

a resistance element being disposed between the first end of the electrode and the headstock; and a pyrotechnic ignition charge being disposed in said cavity, wherein the electrode is electrically insulated from the electrode housing and the head stock.

19. The ignition element of claim 18, wherein the headstock is comprised of chrome-moly alloy steel.

20. The ignition element of claim 18, wherein the electrode housing comprises a first part of a two part threaded fitting, and wherein the headstock comprises a complimentary second part of the two part threaded fitting such that the electrode housing is threaded into the headstock.

21. The ignition element of claim 18, further comprising a primer charge being separated from said pyrotechnic ignition charge by at least one burst disk, wherein said primer charge comprises an ignitable powder disposed in a booster holder.

22. The ignition element of claim 21, wherein the primer charge comprises ignitable powder disposed in a booster holder.

* * * * *